United States Patent [19]

Wilnau

[11] Patent Number: 4,669,234

[45] Date of Patent: Jun. 2, 1987

[54] PREFABRICATED WALL SECTION

[76] Inventor: John A. Wilnau, P.O. Box 13529, Orlando, Fla. 32859

[21] Appl. No.: 713,323

[22] Filed: Mar. 18, 1985

[51] Int. Cl.[4] ..... E04B 1/18

[52] U.S. Cl. ..... 52/98; 52/426; 52/427; 52/381

[58] Field of Search ..... 52/98, 258, 378, 379, 52/381, 383, 414, 410, 426, 427, 576, 577; 249/37, 39, 40, 42, 190, 216, 219 W

[56] References Cited

U.S. PATENT DOCUMENTS

| | | | |
|---|---|---|---|
| 958,419 | 5/1910 | Mowat | 249/39 |
| 1,036,468 | 8/1912 | Dyhrkopp | 249/219 W |
| 1,053,231 | 2/1913 | Schweikert | 52/426 |
| 1,473,418 | 11/1923 | Borel | 52/427 |
| 2,073,548 | 3/1937 | Betzler | 52/427 |
| 2,109,009 | 2/1938 | Hadley | 52/381 |
| 2,212,906 | 8/1940 | Volkes | 52/427 |
| 2,234,797 | 3/1941 | Burner | 52/427 |
| 2,602,620 | 7/1952 | Patton | 249/219 W |
| 2,718,138 | 9/1955 | Jones | 52/381 |
| 2,977,659 | 4/1961 | Buxton | 249/42 |
| 3,236,486 | 2/1966 | Allen | 249/219 W |
| 3,415,484 | 12/1968 | Klaiss | 249/42 |
| 4,426,061 | 1/1984 | Taggart | 52/309.12 |

OTHER PUBLICATIONS

All Weather Wood Foundation Systems, American Plywood Association, 1978, pp. 6–7.

*Primary Examiner*—Henry E. Raduazo

*Attorney, Agent, or Firm*—William M. Hobby, III

[57] ABSTRACT

A prefabricated wall section apparatus includes a pair of pressure treated plywood panels having a plurality of furring strips attached to one side of each panel. A plurality of spacing tie members space the pair panels a predetermined distance apart. The panels are held together by a plurality of fastener members for attaching the panels together, spaced by the spacing tie members with the fastener members attached through the furring strips and panels, so that the furring strips act as reinforcing strips as well as furring strips for the prefabricated wall. Column and beam forming internal walls are located between the pair of connected panels to make three sides of one or two columns and one beam form between the pair of panels so that the prefabricated wall section can be set up and concrete poured therein. The prefabricated wall sections are attached to a foundation adjacent each other so that two adjacent prefabricated wall sections can form one column form. A plurality of Waler Brackets are attached to one side of each panel. The brackets may be attached flat with one end under a furring strip and bent perpendicular to the panel for placing walers therein for additional support during the pouring of the columns and beam. The column and beam form walls also isolate interior space for wall insulation.

11 Claims, 7 Drawing Figures

FIG. 1
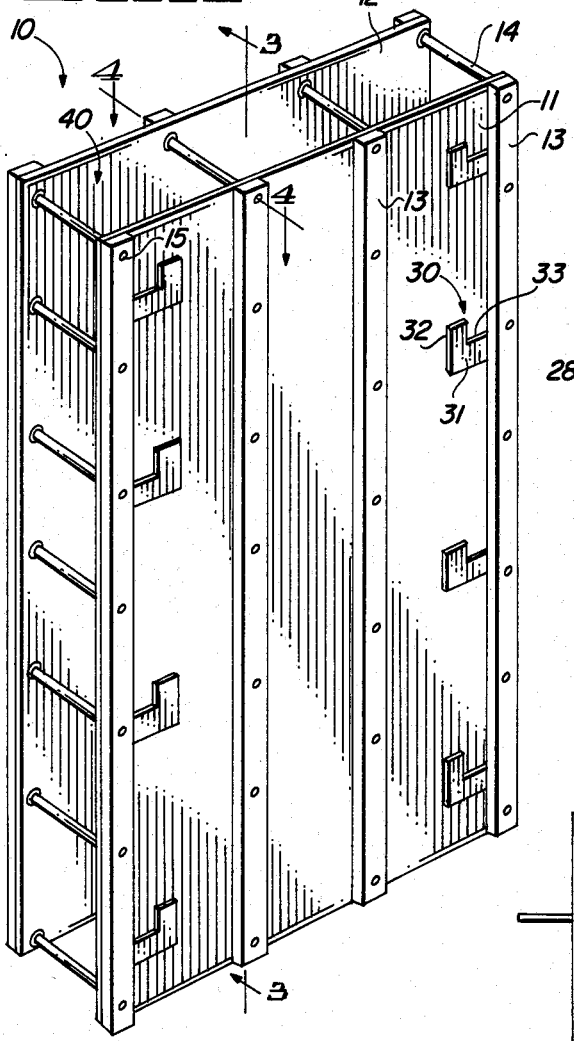
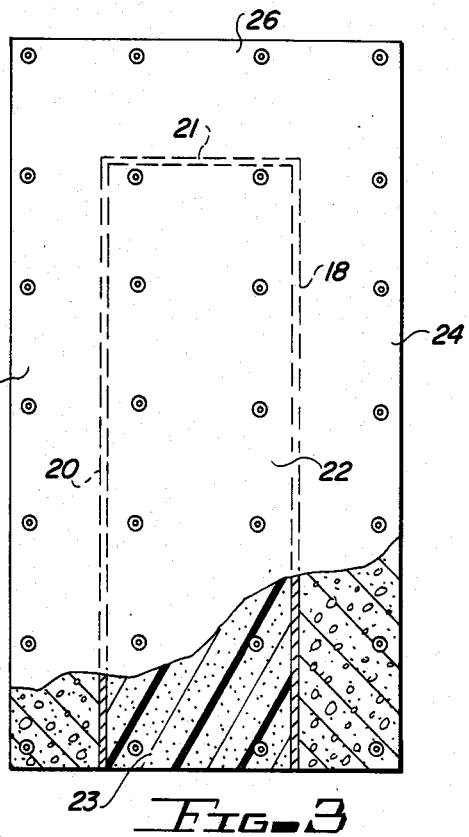
FIG. 3
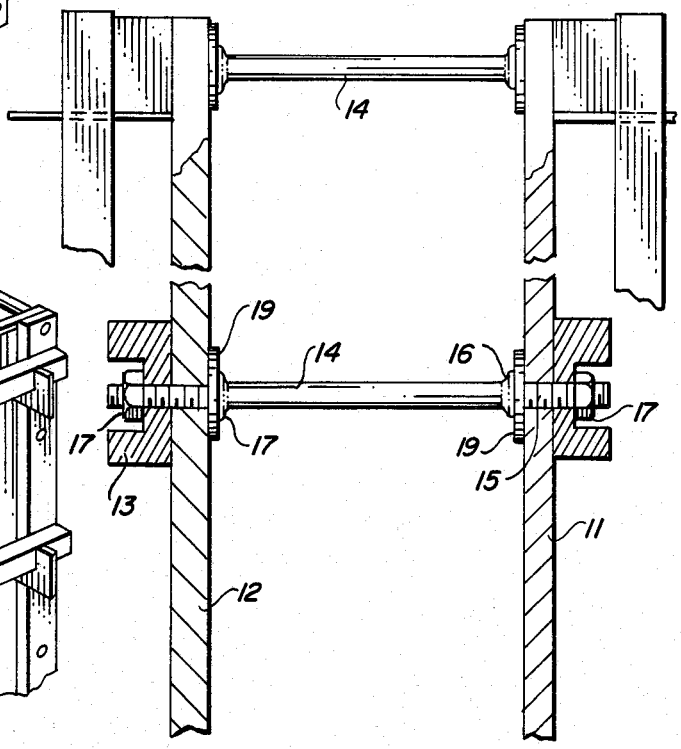
FIG. 4
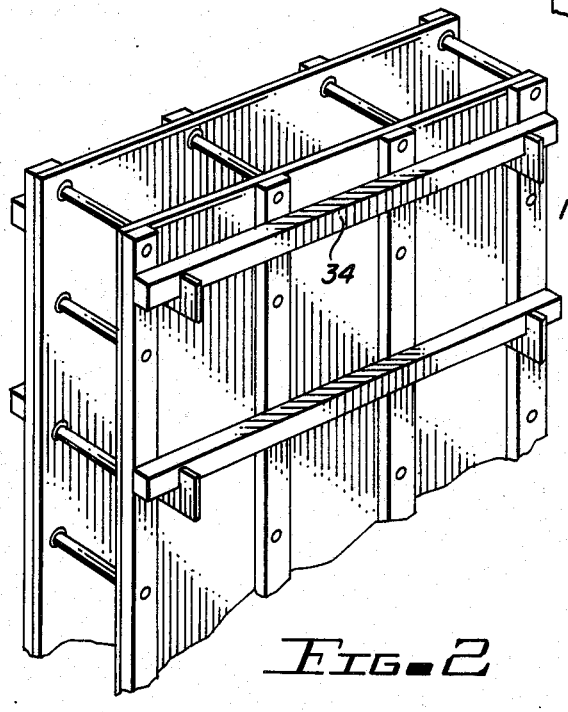
FIG. 2

PREFABRICATED WALL SECTION

BACKGROUND OF THE INVENTION

The present invention relates to prefabricated wall sections and especially to a prefabricated wall section having column beam forms built therein for pouring a concrete column and beam.

In the past, it has been common to provide a great variety of prefabricated wall sections. Typically, building walls are built of block or brick, built up on a foundation by masons, or alternatively, may be made of materials such as wood, glass or steel. In larger buildings it is common to either build a steel framework or to pour reinforced concrete columns and beams for supporting prefabricated wall sections. Prefabricated wall sections can be made of poured concrete or may be glass or any material desired which is attached to the column and beams forming the framework for the building.

The present invention relates to a prefabricated wall section in which panels are formed for attaching to a foundation, and once a plurality of panels are set up, both columns and beams may be poured in the column and beam forms built into the prefabricated wall sections. Both column and beam forms may be complete with reinforcing bars and may be made to isolate the center section between a pair of panels which is filled with insulation. The panels come complete with the furring strips for placing the electrical and or additional insulation as desired, as well as to provide additional support during the pouring of the concrete in column and beam form. The special Waler brackets allow walers to be quickly attached to the existing prefabricated wall sections for tying the wall sections together and reinforcing the concrete pour. It is accordingly an aim of the present invention to combine prefabricated wall sections with prefabricated column and beam forms along with built in waler brackets for supporting walers during the pour of the columns and beams.

SUMMARY OF THE INVENTION

A prefabricated wall section includes a pair of panels, each having a plurality of furring strips attached to one side thereof;

a plurality of spacing tie members are used to space a pair panels a predetermined distance apart as well as to add reinforcement between the panels;

a plurality of fastener members attach the panels together spaced by the spacing tie members. The fastening members are attached through the furring strips and panels for additional strength;

column forming walls are located between the pair of connected panels to make at least three sides of one column form between the pair of panels so that the prefabricated wall section can be set up and a column poured therein;

a pair of wall sections can be connected to a foundation to form one column therebetween and to form interconnected beam across the top of the wall sections. The column forming walls also isolate the center space of each prefabricated wall section, which is filled with insulation. Threaded fasteners can be used and the furring strips can be stapled to each panel with a waler bracket positioned with one end beneath a furring strip and having a weakened section for bending the waler bracket on the furring strip for setting up the walers for the concrete pour. Two by four lumber or the like can be used for the walers which are then placed in the waler brackets to hold the wall sections together and to reinforce the panels against the column and beam pour.

BRIEF DESCRIPTION OF THE DRAWINGS

Other object, features and advantages of the present invention will be apparent from the written description and the drawings in which:

FIG. 1 is a perspective view of one prefabricated wall section in accordance with the present invention.

FIG. 2 is a partial perspective of the wall section of FIG. 1 having a waler attached to the waler brackets.

FIG. 3 is a sectional view taken on line 3—3 of FIG. 1.

FIG. 4 is a cuttaway sectional view taken on the line 4—4 of FIG. 1.

DESCRIPTION OF THE PREFERRED EMBODIMENT

Figure 5:
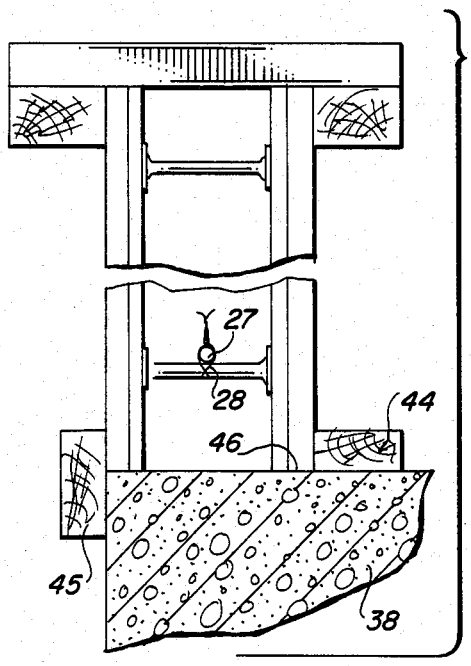
FIG. 5 is an end elevation with the middle portion removed showing attached reinforcing bar.

Referring to the drawings, a prefabricated wall section 10 has a pair of panels 11 and 12 which may be pressure treated plywood panels. Each panel has a plurality of furring strips 13 attached to one side thereof such as by staples or small nails. The panels 10 are spaced by a plurality of spacing tie members 14, which may be hollow cylindrical members. Each panel can be pre-drilled through the furring strips and panels for attachment of a plurality of threaded fasteners 17 which may be countersunk bolts for attaching to the threaded ends 15 on each end of the ties 14 as shown in FIG. 4. The nuts 17 attached to the threaded ends 15 are located in countersunk holes pre-drilled through the furring strips 13 and panels 11 and 12 to give a flat surface to the furring strips for the later attachment of drywall, or the like, on the interior walls. In addition, the ties 14 have enlarged flange 17 abutting against a washer 19 to provide additional support to the pouring of concrete as will be hereinafter described. Each tie member 14 is an elongated steel member having the annular flanges 17 abutting against washers 19 and having each end 15 threaded for receiving nuts 17. Tightening nuts 17 presses the washers 19 against the panels 11 and 12 so that ties 14 space and support the panels.

Each prefabricated panel 10 has a pair of column forming walls 18 and 20, as well as a beam forming wall 21. Walls 18, 20 and 21 are connected together to form a box shape which blocks off the center section of each prefabricated wall 10 in the space 22 which may be filled with insulation 23. At the same time the walls 18 and 19 in connection with the edges of the panels 11 and 12 form a pair of column forms 24 and 25 while the interior wall 21 forms a beam pouring form section 26. Thus, each panel may be set up on foundation adjacent each other so that each panel 10 column space 25 and 24 work in conjunction with the adjacent prefabricated wall section to form a complete column pour which can fill up into the beam area 26 to form one continuous beam. Reinforcing steel bar (REBAR) 27 may be tied to the spacing ties 14 with wire 28, or the like, to provide concrete reinforcing during the pour of the columns and beams. It should be clear that the wall section is so designed that panels 11 and 12 may be pressure treated plywood to provide great strength for the walls of the concrete pour and are further reinforced by the furring strips 13 having the attachements extending therethrough for holding the panels together to further reinforce the concrete pour of the columns and beams.

Prefabricated wall section 10 thus becomes the forms as well as the prefabricated wall section having the insulation therein. The plywood and furring strips remain after the concrete columns and beams are poured so that drywall, or the like, can be attached to the internal wall while external panels can be attached to the furring strips on the exterior of the wall. The space between the furring strips can be used for wiring or may be filled with additional insulation.

Figure 7:
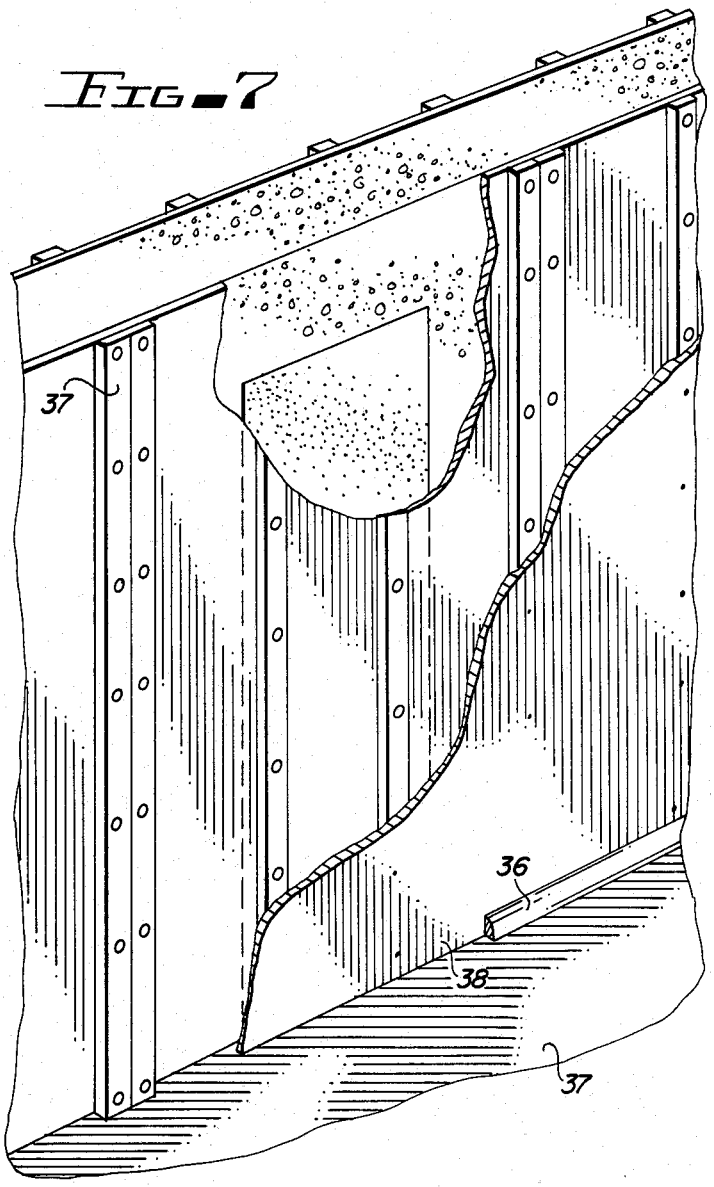
FIG. 7 is a cutaway perspective view of a wall section.

The present invention contemplates the use of a plurality of waler brackets 30 having a flat elongated base 31 and an upstanding portion 32, and a removed or weakened section 33. Waler brackets 30 each have one end attached under one of the furring strips 13 as shown in FIGS. 1 and 2, and are flat during shipment and erection of the prefabricated wall sections. Once the sections are in place, the brackets 30 can be bent on the reduced or weakened portion 33 adjacent to furring strip 13, to a perpendicular position as shown in FIG. 2, and two by four walers 34 can be slid into place in the waler brackets 30 to tie the wall sections 10 together. The waler 34 provide the necessary additional reinforcement on top of the furring strips 13 and panels 11 and 12 to support the pouring of concrete and to form the columns and beams for the panels 10. The formed wall as illustrated in FIG. 7 has the insulation in the center section and the poured concrete columns and beams and shows that when the walers are removed, the waler brackets 30 are broken off so that the wall is ready for the attachment of wall board 35 and floor trim 36. The furring strips 13 have a pair of end furring strips 37 on each panel which come together to give additional reinforcing on the center of the concrete column pour. The wall in FIG. 7 is shown attached to a base of concrete foundation 38.

Figure 6:
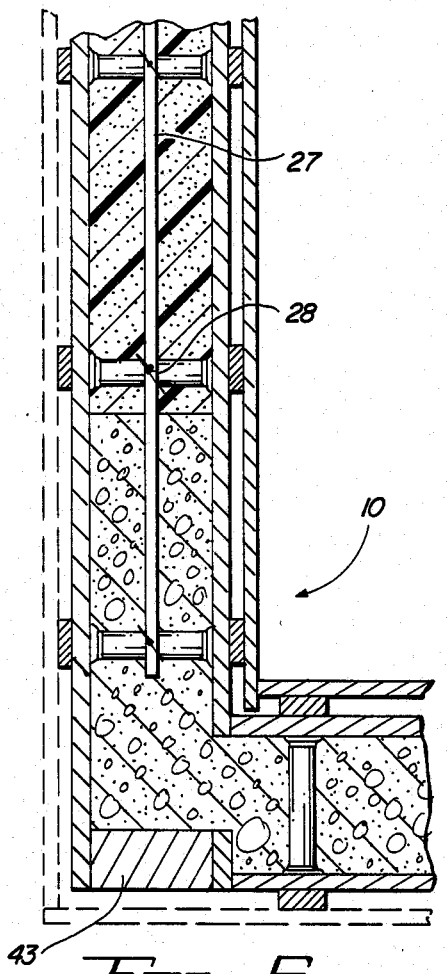
FIG. 6 is a sectional view of a typical corner of the wall section made of the prefabricated wall sections of the prent invention.

In operation a plurality of prefabricated panels are attached to a foundation 38 and the REBAR 27 is attached therebetween with steel wire ties 28 to extend across to more panels 10 to form connecting beam as well as reinforcing REBAR for the columns. The walers 30 are then bent on the weakened area 33 to a perpendicular position and waler members 34 are placed in the brackets 30. At this point, the concrete may be poured into the beam portion 26 open side and allowed to flow through the beam area into the each column area to form the columns and beam for an entire wall with one continuous pour, reinforced by the reinforcing REBAR 27. Once the concrete is cured, the walers 34 can be removed and the brackets 30 broken off at the reduced area 33. Poured concrete walls will thus have the insulation 23, as well as insulation provided by the pressure treated plywood panels 11 and 12. Wiring may be extended between the furring strips 13 and a thin sheet of insulation may also be placed there between. Drywall 35 can then be attached to the furring strips in a conventional manner on one side while exterior walls surfaces can be attached to the furring strips on the other side. The concrete columns and beams are further reinforced by the internal spacing tie members 14 which also remain in the poured concrete. Thus the prefabricated wall sections can be rapidly put in place, the concrete pour made and the walls finished to form a building. Special wall panels 41 can have one extending panel portion 42 for use on a corner as shown in FIG. 6 to combine with a typical wall panel 10 by placing a two inch corner board 33 to form a typical corner so that the corner can act as a continuous beam therearound and would form one of the columns of the building. The panels 10 may be attached to a foundation 38 with two by four members 44 and 45 attached to extend over the bottom edge 46 of each prefabricated panel 10 to line up each wall section 10 and to prevent excess leakage of concrete during the concrete pour. In addition, the walers tie the walls together and allign the wall panels with each other.

It should be clear at this point that a prefabricated wall section, as well as the process of installing a wall with prefabricated wall sections has been provided. It should however, also be clear that the present invention is not intended to be limited to the forms shown which would be considered illustrative rather than restrictive.

I claim:

1. A prefabricated wall section comprising:

a pair of panels;

a plurality of pressure treated wood furring strips attached to one side of each panel and having predrilled holes through said furring strips and panels;

a plurality of spacing tie members for spacing said pair of panels at predetermined distance;

a plurality of fastener members for attaching said panels together, spaced by said spacing tie members, said fastener tie members being attached through the predrilled holes in said furring strips and panels;

column forming walls located between said pair of connected panels to make at least three sides of one column form between said pair of panels, whereby said prefabricated wall section can be set up and a column poured therein; and a plurality of waler brackets attached to each prefabricated wall section panel for attaching walers thereto each waler bracket being flat along the prefabricated wall section with one end extending under one of said pluralities of furring strips, whereby each waler strip may be bent for attaching walers.

2. Prefabricated wall section in accordance with claim 1 in which said plurality of fastener members are threaded fasteners.

3. Prefabricated wall section in accordance with claim 2 in which said furring strips are stapled to each said panel.

4. A prefabricated wall section in accordance with claim 3 in which said predrilled holes are countersunk for receiving countersinking threaded fasteners.

5. A prefabricated wall section in accordance with claim 4 in which said pair of panel are pressure treated plywood panels.

6. A prefabricated wall section in accordance with claim 1 in which each waler bracket has a weakened portion adjacent the attached furring strip whereby each waler bracket can be bent to an approximately perpendicular position to the pair of panels, and each waler bracket has a generally vertically extending portion on the end thereof, whereby walers can be placed therein once the waler brackets are bent into their perpendicular position;

7. A prefabricated wall section in accordance with claim 6 in which each waler bracket has a weakened portion having a removed portion adjacent to each furring strip and may be broken off at the weakened portion.

8. A prefabricated wall section in accordance with claim 1 in which a plurality of reinforcing members are placed within each column form portion.

9. A prefabricated wall section in accordance with claim 8 in which each prefabricated wall section forms at least three sides of two column forms so that when attached to adjacent prefabricated wall sections, two columns are formed therein.

10. A prefabricated wall section in accordance with claim 7 in which a beam forming wall is located between said pair of connected panels to make a beam form interconnected with said column forms for pouring said beams and columns at the same time.

11. A prefabricated wall section in accordance with claim 1 in which insulation is attached between said prefabricated wall section in between said column forming walls located therebetween.

* * * * *